United States Patent [19]

Johnson et al.

[11] Patent Number: 4,828,514

[45] Date of Patent: May 9, 1989

[54] ELECTRICAL CONNECTOR WITH COMPLIANT SECTION

[75] Inventors: Robert R. Johnson, Ludlow; Robert S. Orbanic, Warren, both of Pa.

[73] Assignee: GTE Products Corporation, Stamford, Conn.

[21] Appl. No.: 146,445

[22] Filed: Jan. 21, 1988

[51] Int. Cl.[4] ..... H01R 13/428

[52] U.S. Cl. ..... 439/751; 439/82

[58] Field of Search ..... 439/82, 751, 825–827, 439/873

[56] References Cited

U.S. PATENT DOCUMENTS

| | | | |
|---|---|---|---|
| 4,274,699 | 6/1981 | Keim | 439/751 |
| 4,596,437 | 6/1986 | Rush | 439/82 |
| 4,606,589 | 8/1986 | Elsbree, Jr. et al. | 439/82 |
| 4,701,140 | 10/1987 | Orbanic | 439/873 |
| 4,759,721 | 7/1988 | Moore et al. | 439/82 |
| 4,769,907 | 9/1988 | Sebastien | 439/82 |

*Primary Examiner*—Gary F. Paumen

*Attorney, Agent, or Firm*—William H. McNeill

[57] ABSTRACT

A solderless, compliant connector formed from heavy gauge, i.e., 0.045" square wire. The compliant portion comprises first and second oppositely disposed, laterally spaced wedges having a gap therebetween. The wedges have inwardly facing sections which are triangular and outwardly facing surfaces which are arcuate.

2 Claims, 3 Drawing Sheets

ELECTRICAL CONNECTOR WITH COMPLIANT SECTION

TECHNICAL FIELD

This invention relates to electrical connectors and more particularly to such connectors having a compliant section. Still more particularly, it relates to such connectors for insertion into plated through holes in printed circuit boards.

BACKGROUND ART

Modern electronic apparatus makes extensive use of printed circuit boards employing plated through holes (PTH). As an alternative to soldering connectors in these holes, it has been Proposed to use connectors which engage the hole by friction only. Such connectors generally employ a compliant section for engagement to provide good mechanical and electrical contact. It is desirable that minimum damage be done to the PTH so that such connectors can be removed and replaced. The compliant connectors generally available take several forms: the "eye-of-the-needle" approach, as shown in U.S. Pat. Nos. 3,545,080; 3,634,819; and 4,206,964: the "split beam" approach, shown in U.S. Pat. Nos. 4,066,326; 4,186,982; and 4,443,053; and the "C" section, as shown in U.S. Pat. No. 4,076,356. Another technique has utilized a straight pin having a quadrangular PTH engaging section whose diagonal exceeds the PTH diameter. The latter approach causes considerable damage to the plating and is not suitable for many applications.

Yet another technique is shown in U.S. Pat. No. 4,701,140. Therein, the compliant portion is formed in a double "C" or "split O" configuration. This works well for wire sized to 0.025" square; however, it lacks some desired rigidity for a larger size connector.

While some of the techniques work to a greater or lesser extent, all have one or more problems, such as cost of making; failure to form a good gas tight seal with the PTH; difficulty with insertion; or difficulty of removal.

DISCLOSURE OF THE INVENTION

It is, therefore, an object of the invention to obviate the disadvantages of the prior art.

It is another object of the invention to enhance electrical connection in plated through holes.

Yet another object of the invention is the provision of an electrical connector for PTH's which achieves the above objects and, additionally, provides ease of insertion and removal with minimal plating damage.

Still another object is the provision of a compliant connector having increased rigidity suitable for use with larger diameter PTH's.

These objects are accomplished, in one aspect of the invention, by the provision of an electrical connector which has a compliant portion comprised of first and second oppositely disposed, longitudinally spaced wedges having a gap therebetween. The wedges have, in cross-section, inwardly facing, substantially triangular surfaces and outwardly facing, substantially arcuate faces.

Connectors so made obviate the disadvantages of the prior art. They are relatively easy to make, provide good contact with PTH's and are ideally suited for use with PTH's of larger than usual diameter; i.e., holes having diameters greater than 0.070".

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
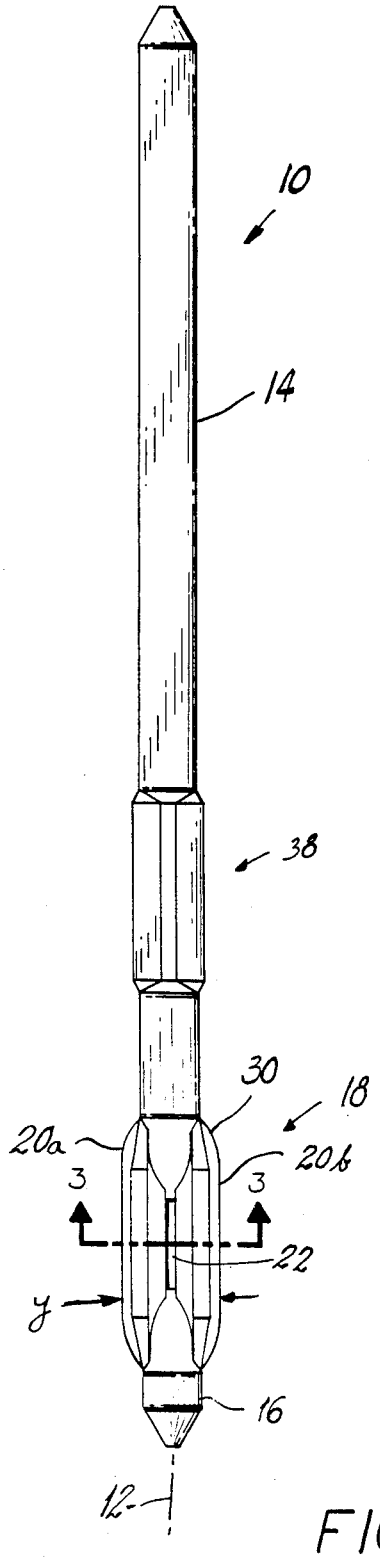
FIG. 1 is a front elevational view of an embodiment of the invention.

Referring now to the drawings with greater particularity, there is shown in FIG. 1 an electrical connector 10 having a longitudinal axis 12. Connector 10 has first portion 14 and second portion 16 which are substantially rigid and spaced apart.

Figure 3:
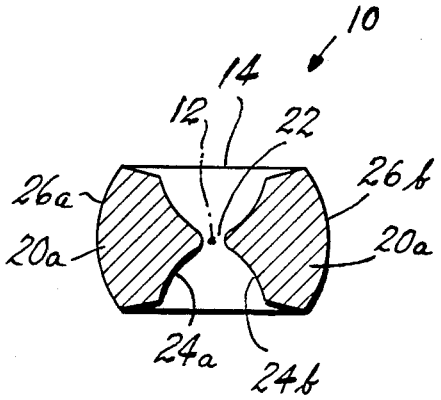
FIG. 3 is a sectional view taken along the line 3—3 of FIG. 1.

The longitudinally spaced apart first and second portions are 14 and 16 separated by and joined to a compliant portion 18 comprises first and second oppositely disposed, laterally spaced apart wedges 20*a* and 20*b* having a gap 22 therebetween. The inwardly facing parts 24*a* and 24*b* of wedges 20*a* and 20*b* are substantially triangular in cross-section, as seen in FIG. 3 and the outwardly facing surfaces 26*a* and 26*b* are substantially arcuate. Preferably, the radius of the arcuate surfaces should match the radius of the aperture into which the compliant portion 18 will be inserted.

The ends 28 and 30 of the compliant portion 18 are smoothly radiused to join the first and second portions 14 and 16.

In the illustrated preferred form, the first and second portions 14 and 16 are square in cross-section, e.g., 0.045" on a side. The material of the connector 10 is preferably phosphor bronze.

Figure 2:
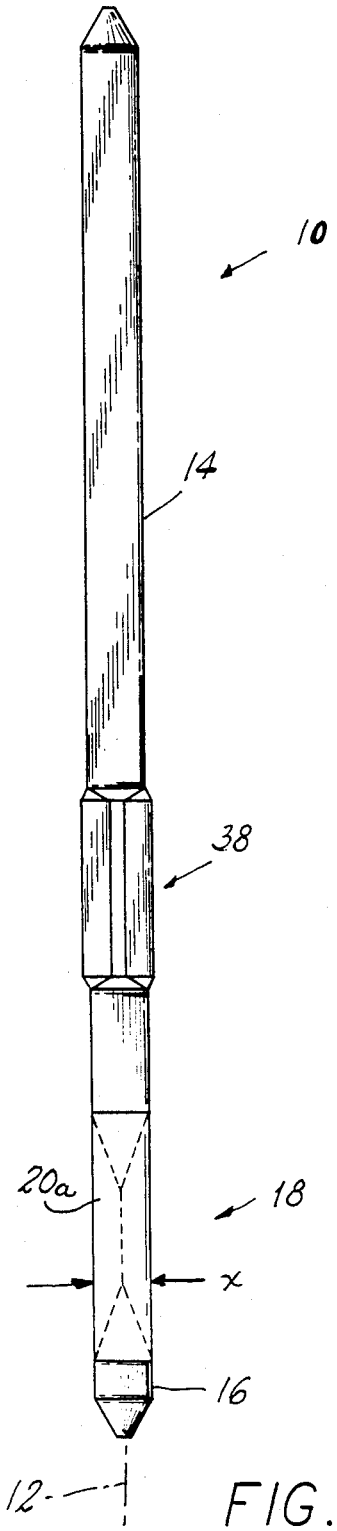
FIG. 2 is a side elevational view.

As can be seen from the drawings the compliant portion 18 is formed by expanding the connector in only one direction. That is, portion 18 has a first overall dimension "X" (see FIG. 2) which is substantially equal to a side of the square section and a second overall dimension "y" (see FIG. 1) which is about 170–175% of the first dimension.

Figure 4:
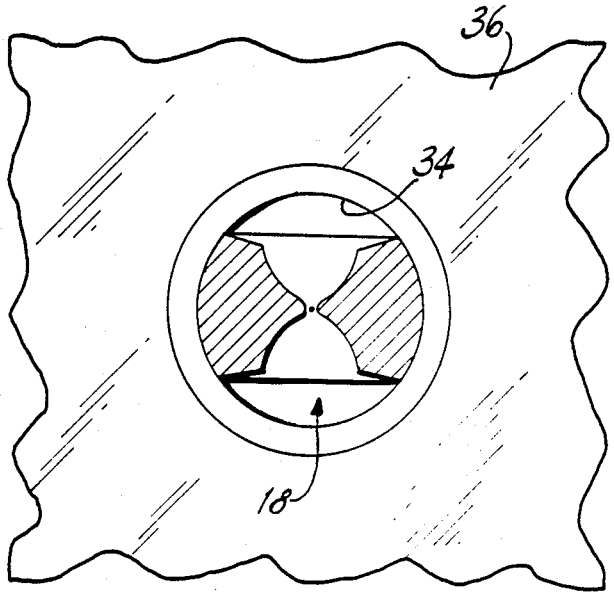
FIG. 4 is a plan view similar to FIG. 3 showing a connector in a PTH.

Thus dimension "y" is about 0.078". Such a compliant portion is ideally suited for insertion into a PTH 34 in a printed circuit board 36 wherein the PTH has a diameter of about 0.073"±0.002" (see FIG. 4). Because of the rigidity of the relatively heavy material employed herewith, the importance of the gap 22 is emphasized; i.e., the lateral dimension of the gap as formed (FIG. 3) must be greater than the difference between dimension "y" and the PTH diameter so that some space remains after insertion of connector 10 into a board 36, otherwise, the board might warp.

Connector 10 can be also provided with an additional holding means 38, shown formed in first portion 14, whereby the connector 10 can be retained in a connector block (not shown).

While there have been shown and described what are at present considered to be the preferred embodiments of the invention, it will be apparent to those skilled in the art that various changes and modifications can be made herein without departing from the scope of the invention as defined by the appended claims.

We claim:

1. An electrical connector for insertion in a plated-thru-hole in a printed circuit board, said connector being formed from 0.045" square material, and having a longitudinal axis and first and second spaced apart portions which are substantially square in cross-section and a compliant portion between said first and second portions, said compliant portion comprising: first and second oppositely disposed, laterally spaced wedges having a gap therebetween, each of said wedges having, in cross-section, inwardly facing substantially triangular surfaces symmetrically arrayed along a transverse axis, and outwardly-facing, substantially arcuate faces, said compliant portion having a first overall dimension substantially equal to a side of said square section and a second overall dimension which is about 170–175% of said first dimension, said gap being great enough so that the apices of said wedges do not come into contact when said connector is inserted into said plated-thru-hole.

2. The electrical connector of claim 1 wherein said second dimension is measured transverse to said first dimension.

* * * * *